United States Patent [19]

Montgaillard et al.

[11] 4,302,702

[45] Nov. 24, 1981

[54] THERMIONIC CATHODE HAVING AN EMBEDDED GRID, PROCESS FOR ITS FABRICATION, AND HIGH FREQUENCY ELECTRON TUBES USING SUCH A CATHODE

[75] Inventors: Jean Montgaillard; Arvind Shroff, both of Paris, France

[73] Assignee: Thomson-CSF, Paris, France

[21] Appl. No.: 904,240

[22] Filed: May 9, 1978

[30] Foreign Application Priority Data

May 13, 1977 [FR] France ..... 77 14773

[51] Int. Cl.[3] ..... H01J 1/46; H01J 17/04; H01J 19/38; H01J 21/10

[52] U.S. Cl. ..... 313/348; 29/25.14; 29/25.17; 313/299; 313/338; 313/447; 313/452

[58] Field of Search ..... 313/348, 349, 444, 447, 313/448, 452, 298, 299, 338; 29/25.14, 25.17

[56] References Cited

U.S. PATENT DOCUMENTS

| | | | |
|---|---|---|---|
| 3,154,711 | 10/1964 | Beggs | 313/348 X |
| 3,638,062 | 1/1972 | Beggs | 313/348 |
| 3,818,260 | 6/1974 | Elfe, Jr. et al. | 313/348 |
| 3,843,902 | 10/1974 | Miram et al. | 313/348 |
| 3,967,150 | 6/1976 | Lien et al. | 313/348 |
| 4,096,406 | 6/1978 | Miram et al. | 313/348 |

*Primary Examiner*—Saxfield Chatmon, Jr.
*Attorney, Agent, or Firm*—Roland Plottel

[57] ABSTRACT

The invention relates to metal oxide activated porous tungsten cathodes and methods of their manufacture. A cathode 1 of porous tungsten activated by metal oxides is mounted on a housing 2 which has a heating filament 3. On the outer face of the cathode there is a pattern or grid of pure tungsten (preferably formed by a chemical vapor deposition of $WCl_6$ or $WF_6$) of crystalline material the outer face of which has an orientation in the (100) or (110) plane and is parallel to the surface of the cathode. The invention will find particular use in the cathode guns of high frequency tubes such as traveling wave tubes and klystrons.

9 Claims, 14 Drawing Figures

FIG. 1
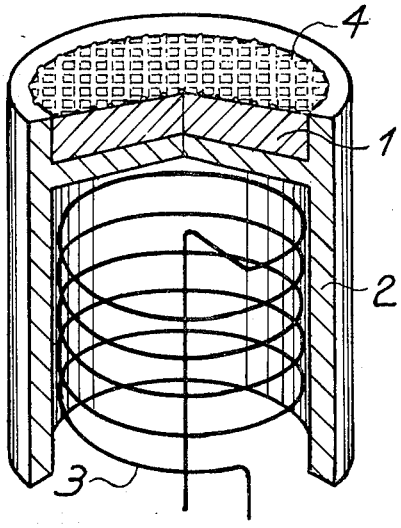
FIG.2A
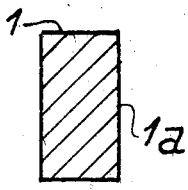
FIG. 2B
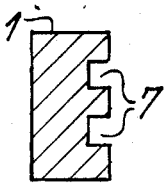
FIG. 2C
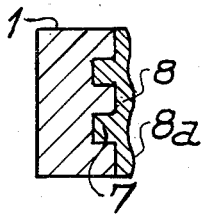
FIG. 2D
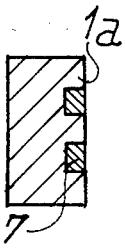
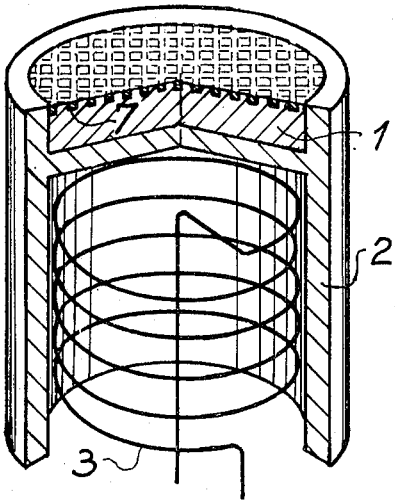
FIG. 3

FIG.4A
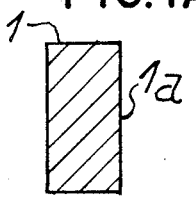
FIG. 4B
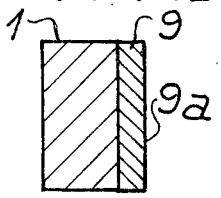
FIG. 4C
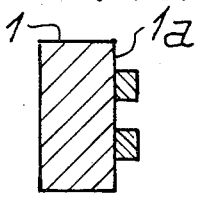
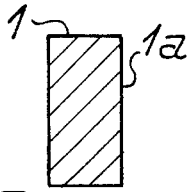
FIG.5A
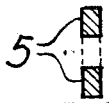
FIG.5B
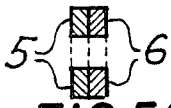
FIG.5C
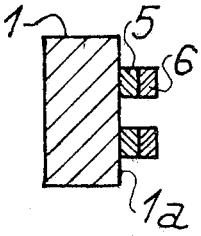
FIG.5D
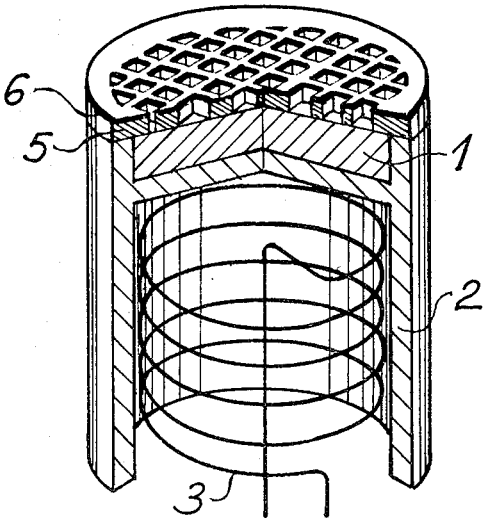
FIG. 6

THERMIONIC CATHODE HAVING AN EMBEDDED GRID, PROCESS FOR ITS FABRICATION, AND HIGH FREQUENCY ELECTRON TUBES USING SUCH A CATHODE

The present invention relates to electron sources and particularly to thermionic cathodes that are to be used (in association with at least a control grid) in different types of electronic tubes and particularly those of high frequency, such as travelling wave tubes, klystrons, etc. It relates particularly to cathodes of the type that are sometimes called embedded grids as well as electronic tubes incorporating such cathodes.

These sources are part of a group of devices called electron guns designed to deliver a beam of electrons of high density in certain cases. In order to avoid prohibitive heating of the control grid, and to improve the electronic performance of these guns, it has been usual to place a supplemental grid between the cathode and the control grid in such a way that the mesh of the grid furthest away from the cathode is located in the electronic shade of the nearest grid.

It is possible to improve and increase the electronic qualities of this gun by incorporating the mesh of the nearest grid onto the surface of the cathode itself or shadow grid. This leads to the creation of non-emissive zones at theoretical locus of the mesh surrounding zones with normal emissivity. For this, simple solutions have been proposed, for example in the case of non-emissive cathodes of pure nickel by the localized deposits of a material whose work function is weaker, barium oxide for example.

Although a cursory examination might lead one to think that the same simple solution would be used for the formation of localized non-emissive zones on the body of the cathode itself with low work function, in fact the many solutions that have been proposed (for example those described in published French patent application No. 2,299,720), are much more complex.

This is so because in known solutions there was no way of avoiding making a temporary protective screen (to be eliminated in a subsequent step) between the body of the cathode made in porous tungsten (activated by the impregnation of a compound with an oxide of alkaline earths basis) and deposits of non-emissive material. Unless such a screen is made, it is found that during operation of the tube, the non-emissive zones are activated by surface migration from the cathode of the alkaline earths activators (e.g. the Ba or its oxide BaO). Thus, the zones lose their non-emissive property because of this migration.

The experiments of the inventors have led to the conclusion that by making a localized deposit of pure crystalline tungsten on a porous tungsten cathode impregnated with an activating product (barium oxide for example) so that the 100 or 110 crystal plane, i.e. its high work function surface is parallel to the substratum surface—that is to say to the emission surface of the porous cathode—the eventual migration of the compounds with alkaline earths oxide on the faces thus oriented does not lower the work function of the crystalline tungsten to a critical level.

Furthermore, although the cathode is in porous tungsten, the tungsten deposit is advantageous particularly with regard to heat expansion.

The invention has as an object a thermionic cathode in porous tungsten with a low work function by impregnation with an alkaline earths oxide base or by diffusion of an emissive product, and having non-emissive zones; characterized in that said non-emissive zones are constituted by a crystalline material deposited in such a way as to present a high work function surface relative to that of the impregnated body of the cathode. Said material is specifically deposited in such a way that one of said faces is parallel to the emission surface of the cathode body.

According to a first method of the invention, the material of inactivation previously defined is deposited by chemical vapor deposition on the entire emitting surface of a cathode; it is then taken away from those regions that are to remain emissive.

According to a second method of the invention, grooves or hollows are formed on the emissive surface of the cathode and then through the same process as before the same non-emissive material is deposited. The excess material (not in the hollows) is carefully taken out (through electroerosion for example), so as not to alter the crystalline orientation of the material remaining at the surface.

According to a third method of the invention, the same non-emissive material is deposited on one face of a supporting grid in any material compatible with the body of the cathode and with the material of inactivation. The grid is then made compatible with the cathode surface.

The invention will be understood better after the following description is read and several examples of the method are given and by referring to the corresponding drawings among which:

FIG. 1 is a perspective view of a cathode structure partially cut in the vertical plane to the vertical axis.

FIGS. 2*a* to 2*d* are schematic cross sectional views showing the successive stages of a first process in which the embedded or incorporated grid is formed.

FIG. 3 is a view similar to FIG. 1 but where the grid is made according to the process illustrated in FIGS. 2*a* to 2*d*.

FIGS. 4*a* to 4*c* are schematic cross sectional views showing the successive steps of a second process of the development of the incorporated grid.

FIGS. 5*a* to 5*d* are schematic cross sectional views showing the successive steps of a third process of the formation of the incorporated grid.

FIG. 6 is a perspective view partially cut away of a cathode structure illustrating (not to scale) the grid of FIGS. 5*c* to 5*d*.

In the following description that illustrates the invention in non-limiting examples, the cathode is described as being of porous tungsten activated by an impregnated barium oxide. It should be understood that it may also be activated by a mixture of alkaline earths or alkaline earths and aluminum.

In FIG. 1 there is shown an example of a cathode in perspective, partially cut in a vertical plane, and showing the emissive cathode. The device has a body of the cathode itself 1 (made for example of porous tungsten) whose pores are filled with barium oxide, emissive at the operating temperatures. The cathode body 1 is supported in a housing 2 that is of refractory material and a good conductor of heat (for example, molybdenum). A heating filament 3 whose energy source is not shown (so as not to encumber the Figure unnecessarily), is designed to bring the surface of the cathode to its normal operating temperature.

The active surface of the cathode assumed here to be plane is shown in perspective. On this surface, the lattice or grid 4 are non-emissive zones.

Zones 4 are preferably made according to one of the processes illustrated in FIG. 2*a* to 2*d*, 4*a* to 4*c*, or 5*a* to 5*d*. For simplification in these Figures, the cathode is shown without its external housing, as being flat, but the invention, and the processes for making it which are described, may also be done in different shapes (for example, a cathode having a surface that is concave, convex, a cylinder of revolution, or other useful shape).

Turning now to FIG. 2*a* to 2*d* which illustrate a first process, in FIG. 2*a*, the cathode 1 is porous tungsten. The process is started with this material. FIG. 2*b* shows hollows 7 formed in the outer emissive surface 1*a* of the cathode. For this step, the pores of the tungsten temporarily or provisionally contain a material which strengthens or consolidates it, and facilitates manufacture (for example, copper may be used).

The depth, width and location of the hollows may be varied, and depends on several parameters, including the shape of the control grid on which the grid formed above the cathode must cast its shadow. Typical dimensions of the hollows vary between 0.01 and 0.3 mm.

According to a preferred embodiment that is non-limitating, the hollows can be formed in the body 1 by any convenient and conventional process mechanically (abrasives and cutting tools), chemically, electrochemically, by electroerosion, etc.

In FIG. 2*c*, a layer of tungsten 8 is deposited by chemical vapor deposition (CVD) of tungsten hexafluoride $WF_6$ or tungsten hexachloride $WCl_6$, in the presence of hydrogen between 600° and 1100° C. The layer thus formed on side 8*a* away from the body 1 has a crystal orientation in (100) plane and a work function of 4.7 eV at the operating temperature of the cathode, while that of the surface of the body of the activated tungsten is between 2 to 2.4 eV approximately. A layer having a (110) plane, and whose work function is a little bit higher (5 eV), can be obtained through a specific procedure of the pyrolisis process. FIG. 2*d* shows the cathode after further processing in which the surface has been smoothed by taking out the excess deposit of tungsten so that it only remains in the hollows. This can be made by following any known process, but care must be taken to modify the crystalline orientation as little as possible. An electroerosion process in which the metal is removed perpendicular to the surface is a particularly good one.

If the cathode body had a strengthening/consolidation material, the hardening agent can now be eliminated, for example by heating, or chemically (for example, copper that is previously mentioned); and it can then be replaced by an emissive material; the cathode is then ready to be sealed to the housing according to any convenient or conventional procedure.

In FIG. 3 the cathode with an incorporated grid that is obtained as seen in section and perspective.

FIGS. 4*a*–4*c* illustrate another embodiment of the method of this invention. FIG. 4*a* as FIG. 2*a* shows a porous tungsten body which is the starting material. In FIG. 4*b* by the same procedure as before, a layer of tungsten 9 has been deposited presenting on its face 9*a* (opposed to face 1*a* of the body) a crystal orientation (100) or (110). In FIG. 4*c* the tunsten of zones that should be emissive has been removed with the care previously mentioned. For this process the holes are made in the deposited layers so that preliminary strengthening/consolidation of the cathode is not needed. However, if it is undertaken, elimination of the strengthening/consolidation material, and filling with the activator as in the case of the process illustrated in FIGS. 2*a* and 2*d* will be carried out.

It might be advantageous to do away with the temporary strengthening/consolidation steps, i.e. deposit the pure tungsten on an intermediate support. This process is illustrated in FIGS. 5*a* to 5*d* where 5*a* shows the initial body 1 of porous tungsten filled with emissive material. In FIG. 5*b*, there is a bare support grid 5. In FIG. 5*c* the grid 5 has a layer of pure tungsten 6 deposited thereon as described in the two previous methods. In FIG. 5*d* the grid 5–6 (shown in FIG. 5*c*) is joined to the cathode body 1, by any convenient or conventional means such as brazing, welding, crimping, encrustation, etc.

FIG. 6 is a vertical, partially cut away perspective view of the cathode structure that illustrates the step carried out between FIGS. 5*c* and 5*d*. Here, the grid has been placed on the cathode.

The grid 5 should be made of a refractory material (molybdenum, zirconium, or preferably tungsten), but although cost considerations dictate that this grid be made of a non-emissive material (or at the very least, a material whose emissivity is not essential), unlike the cathodes previously considered it does not matter whether the material is emissive or not. In prior cathodes, however, a protective inert material must be placed between the emissive body of the non-emissive deposits.

It is obvious that the tungsten deposit is made on the grid's surface facing outwardly; the other face may also find itself processed in the course of the invention's working, but without any particular gain.

Non-emissive zones of pure tungsten that are made according to one or the other of the processes described, present a very great stability while the tube is operating due (1) to the stability of the non-emissive properties of the crystalline orientation (100) or (110) of pure tungsten (this is true even if they are covered with the film of the activating product that is formed through migration in the course of the tube's operation); and (2) to the absence of adverse reaction between the non-emissive and emissive zones.

Moreover, in the first two processes described, the successful cohesion between porous tungsten and tungsten deposited by chemical vapor deposition facilitates the operation of the cathode device because of the solidity of the link between the two parts. This strong cohesion equally favors the successful operation of the cathode in the course of its heat cycling during the tube's operation. Another advantage is that the two materials which are in contact have coefficients of expansion that are very close to each other.

In the detailed description, the cathode is of a porous metal which is tungsten, and the metal used for the inactivation is preferably tungsten; but the invention may also be carried out with other cathode bodies, provided that the surface of the deposited material has a work function which is higher than that of the activated cathode, even if it should become covered in the course of operation by a film of activation material due to migration at the surface of the porous cathode, for example, silicon carbide and tungsten disilicide.

We claim:

1. A thermionic cathode with an embedded grid comprising a cathode body of porous tungsten with an emissive activator and having at an emissive surface of the cathode non-emissive zones; said zones being of a center cubic crystalline material and having at least one face having a crystal plane of 100 to 110 whose work function is higher than that of the cathode body; said face being parallel to the emissive surface of the cathode.

2. Cathode according to claim 1 wherein said material is essentially tungsten.

3. A high frequency electronic tube such as a klystron or travelling wave tube having an embedded cathode according to claim 1 or 2.

4. A cathode according to claim 1 wherein said material is silicon carbide or tungsten disilicide.

5. A thermionic cathode with an embedded grid consisting of a cathode body of porous tungsten with an emissive activator and an emissive surface of low work function, zones of a center cubic crystalline material at said emissive surface, said zones having a face which is parallel to and faces away from the emissive surface of the cathode, and whose work function is higher than that of the cathode body, said material being essentially tungsten, and said face having a crystal plane of (100) or (110).

6. A Process for making a thermionic cathode with an embedded grid, comprising a cathode body of porous tungsten with an emissive activator and having at one surface non-emissive zones of a center cubic crystalline material having at least one face with a crystal plane 100 or 110 whose work function is higher than that of the cathode body and is parallel to the emissive surface of the cathode, said process comprising the following steps:

depositing on the emissive surface of the cathode body a layer of said material by decomposition in vapor phase of a halogen compound of the material and with the face away from the cathode body being that face having the higher work function, and removing portions of said deposited layer without substantially modifying its crystalline orientation to expose regions of the cathode body that should be emissive.

7. A process according to claim 6 comprising the steps of first filling the cathode body pores partially with a consolidating material, and after the removing step eliminating said consolidating material, and then filling said pores with the emissive activator.

8. A process for making a thermionic cathode with an embedded grid, comprising a cathode body of porous tungsten with an emissive activator and having at one surface non-emissive zones of a center cubic crystalline material having at least one face with a crystal plane of 100 or 110 whose work function is higher than that of the cathode body and is parallel to the emissive surface of the cathode, said process comprising the following steps:

forming hollows in the surface of the cathode body in those zones which are to be non-emissive, depositing on this surface a layer of said material by decomposition in vapor phase of a halogen compound of the material and with the face away from the cathode body being the face having the higher work function, removing a portion of said layer down to said cathode face, without substantially modifying its crystalline orientation until the surface of the material in the hollows and the emissive surface regions of the cathode body are both exposed.

9. A process for making a thermionic cathode with an embedded grid, comprising a cathode body of porous tungsten with an emissive activator and having at one surface non-emissive zones of a center cubic crystalline material having at least one face with a crystal plane of 100 to 110 whose work function is higher than that of the cathode body and is parallel to the emissive surface of the cathode, said process comprising the following steps:

forming a support grid of a material not suceptible to chemical reaction with the cathode body, depositing on at least one face of said support grid a layer of said material and attaching said grid to the cathode body.

* * * * *